United States Patent [19]

Le Monnier de Gouville et al.

[11] Patent Number: 4,891,006

[45] Date of Patent: Jan. 2, 1990

[54] PILOT FLAME GAS BURNERS AND BURNER CAP FOR THESE IMPROVED BURNERS

[75] Inventors: Jean-Bernard Le Monnier de Gouville; Bernard Dané, both of Veigne, France

[73] Assignee: Sourdillon-Airindex, France

[21] Appl. No.: 242,106

[22] Filed: Sep. 8, 1988

[30] Foreign Application Priority Data

Sep. 8, 1987 [FR] France ..... 8712429

[51] Int. Cl.[4] ..... F23D 14/58

[52] U.S. Cl. ..... 431/349; 126/39 H; 239/559

[58] Field of Search ..... 431/286, 349; 126/39 R, 126/39 H; 239/558, 559

[56] References Cited

FOREIGN PATENT DOCUMENTS 1315505 2/1962 France ..... 431/349

*Primary Examiner*—Carroll B. Dority

*Attorney, Agent, or Firm*—Larson and Taylor

[57] ABSTRACT

In a pilot flame gas burner, particularly for a domestic appliance, comprising principal orifices for main flames distributed peripherally and peripheral gas conduit means beneath the principal orifices to generate at least one pilot flame extending peripherally to heat the foot of the main flames, the invention provides the following improvement. Said peripheral gas conduit means are arranged to generate a pilot flame collar extending continuously over the periphery of the burner without projecting appreciably from the peripheral surface of the burner and so that in zones disposed beneath the principal orifices, and each associated with at least one principal orifice, the pilot flame is more active and is adapted to heat the corresponding feet of the main flames.

8 Claims, 1 Drawing Sheet

PILOT FLAME GAS BURNERS AND BURNER CAP FOR THESE IMPROVED BURNERS

The present invention relates to improvements in or to pilot flame gas burners, particularly for domestic appliances comprising principal orifices for main flames distributed peripherally and peripheral conduit means for gas below said principal orifices to generate at least one secondary flame or pilot flame extending peripherally to heat the foot of the main flames.

In certain pilot flame burners known at present, the pilot flame is unique and it constitutes an uninterrupted flame collar extending over the whole of the perimeter of the burner, at the base of the main flames. In this arrangement, the secondary air necessary for combustion and which arrives at the principal orifices of the main flames through the outside of the burner runs up against the barrier constituted by the annular pilot flame and the contribution of secondary air to the main flames is deficient. As a result combustion of the gas is incomplete and there is a proportionally large release of carbon monoxide CO with respect to carbon dioxide $CO_2$.

In other known pilot flame burners, a second row of orifices is provided placed generally below the row of principal orifices and generating individual secondary flames or pilot flames suitable for heating the respective feet of the principal flames. However, in this known arrangement, the pilot flame orifices are independent of one another in the same manner as the main flame orifices and the result is a possible difficulty in propagation of the flame between the orifices at the time of igniting the burner.

It is hence essentially an object of the invention to provide an improved gas burner arrangement which gives more satisfaction, from this point of view, to the exigencies of practice, and which cumulates the respective advantages of continuous pilot flame burners and of discontinuous pilot flame burners, but which does not have their respective disadvantages, whilst preserving a simple burner structure, inexpensive to manufacture and maintain.

With these objects, a gas burner arranged according to the invention is characterized in that the peripheral gas conduit means beneath the principal orifices are designed to generate a secondary flame collar extending continuously over the perimeter of the burner without however this continuous flame collar projecting appreciably from the peripheral lateral surface of the burner and so that in zones located below the principal orifices and each associated with at least one principal orifice, the pilot flame is more active and more adapted to heat the corresponding feet of the principal flames.

Preferably, the peripheral gas conduit means below the principal orifices are arranged so that a more active zone of the pilot flame is situated beneath each principal orifice.

Due to this improved arrangement, the presence of peripheral gas conduit means on the perimeter of the burner, beneath the row of principal orifice, ensures easy propagation of the pilot flame over the whole perimeter of the burner at the moment of lighting, even though the slight development of this flame collar prevents it from projecting appreciably on the lateral surface of the burner. The function of heating the feet of the main flames is then devolved on discontinuous active zones of the pilot flame which are preferably situated respectively in correspondence with the main flames. As a result, the primary air can rise up along the burner by passing between the active zones of the pilot flame and arrive at the main flames, on each side of the latter. The increase in the amount of secondary air arriving at the main flames procures an important improvement in combustion and leads to a distinct reduction in the volume of carbon monoxide resulting from the combustion and this more particularly during operation at half flow rate of the burner. In other words, the increase in the effect resulting from the secondary aeration is compensatory for the natural reduction of primary air.

In the case of a burner comprising a burner body having an upper portion bounded peripherally by an upwardly projecting brim and a burner cap resting on the burner body through a downwardly projecting peripheral skirt dimensioned to nest within the aforesaid brim of the table of the burner body, the principal orifices being situated in the cap, a particularly advantageous embodiment by reason of its simplicity and its low cost of construction consists of the skirt of the cap having a height substantially greater than the height of the peripheral brim of the burner body so that an annular gap subsists between the cap and the upper edge of said brim, in which gap a continuous collar of secondary flame can develop not projecting appreciably on the lateral surface of the burner body, and in that at least one of the facing surfaces of the skirt of the cap and of the brim of the burner body has projections in the form of small enmeshed columns situated in line with the gaps separating the principal orifices and defining with the opposite surface channels independent of one another whose upper edges constitute respectively secondary orifices, from which the aforesaid more active zones of the main flame can develop, the skirt of the cap having traversing passages situated in line with the principal orifices for leading gas into the independent channels.

Advantageously, the projections in the form of enmeshed small columns are provided on the outer surface of the skirt of the cap.

Just as advantageously, the traversing passages are defined by notches formed in the thickness of the skirt at the base of the latter and by the surface of the burner body on which the base of this skirt rests.

In this way, the features particular to the invention only involve the cap of the burner; the burner bodies may continue to be produced in the same manner and on the same model as previously. In addition, burners of the old type may easily and rapidly be converted into improved burners according to the invention by simple exchange of the caps.

Thus the invention also provides a burner cap designed to equip a gas burner body, which is characterized in that it comprises an upper plate provided with principal orifices distributed peripherally and provided with an annular skirt whose outer surface is furnished with projections in the form of enmeshed small columns situated approximately in line with gaps separating the principal orifices, the base of this skirt being provided with tranversing notches situated respectively substantially in line with the principal orifices.

The invention will be better understood on reading the detailed description which follows of a preferred embodiment given purely by way of non-limiting example; in this description reference is made to the accompanying drawing in which.

Figure 1:
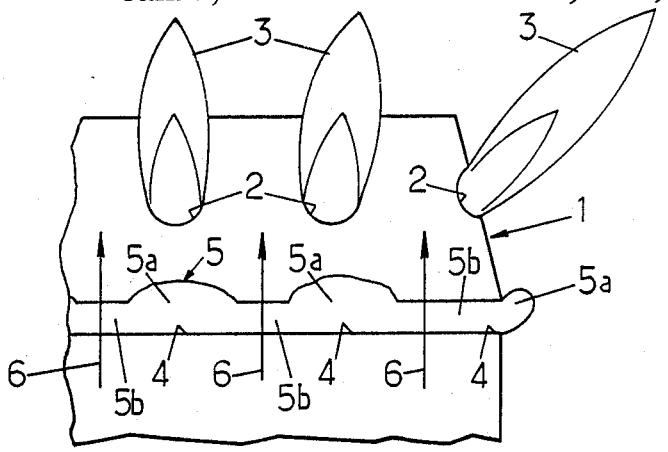
FIG. 1 is a diagrammatic view from the side of a gas burner (shown in operation) arranged according to the invention.

Referring firstly to FIG. 1, a gas burner 1 (shown partly very diagrammatically) comprises at least one peripheral upper row of principal orifices 2 for main flames 3.

Below this row of principal orifices is to be found an annular groove 4 arranged and supplied with gas so that an uninterrupted collar of pilot flame 5 extends in this groove 4 over the whole periphery of the burner, but without projecting appreciably on the lateral wall of the latter and also so that this uninterrupted collar of pilot flame has more active zones 5*a* in the proportion of a more active zone beneath each principal orifice 2, in order that these more active zones 5*a* of the pilot flame may heat the foot of the respective principal flames 3.

Due to this arrangement, secondary air can arrive freely, by passing between the pilot flames 5 (arrows 6), at the main flames 3 without being hampered by the intermediate zones 5*b* of the flame collar situated between the more active zones 5*a* and can improve the combustion of the gas reducing the proportion of carbon monoxide CO.

Figure 2:
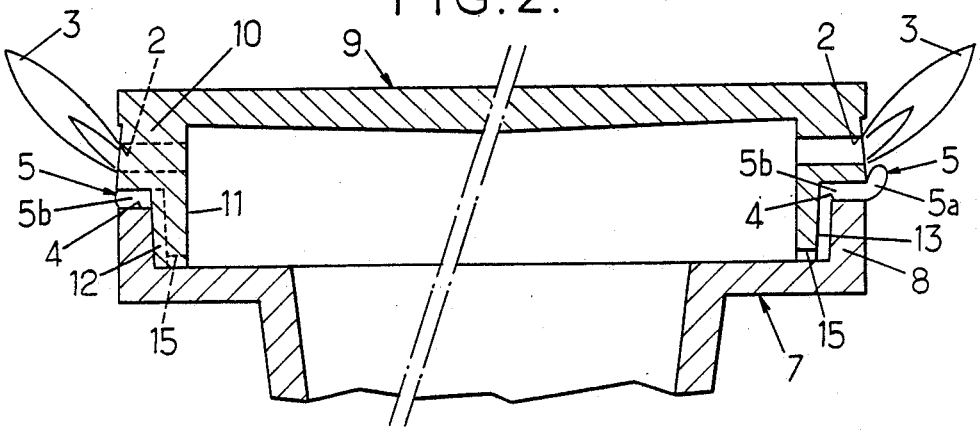
FIG. 2 is a partial diagrammatic view, in cross section, of a gas burner arranged according to the invention.
Figure 3:
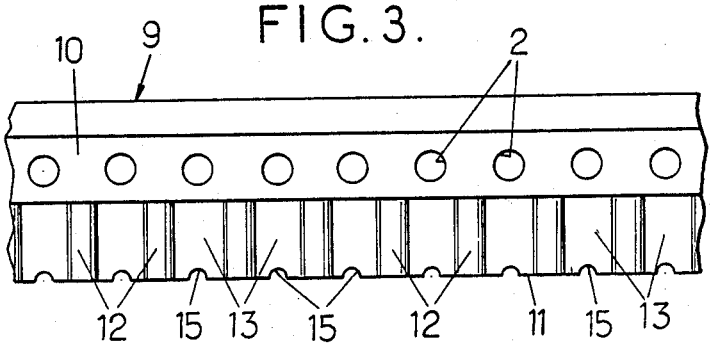
FIG. 3 is a partial side view, with development, of the cap of the burner of FIG. 2.

FIGS. 2 and 3 (in which identical elements with those of FIG. 1 are denoted by the same reference numerals) show a preferred embodiment of a gas burner arranged according to the invention.

The burner comprises a burner body 7 which possesses a peripheral brim 8 projecting vertically upwards. The burner body 7 is capped by a burner cap 9 (shown partially from the side in development in FIG. 3) having an upper plate 10 resting on the burner body 7 through an annular skirt 11 projecting vertically downwards, the skirt 11 being fitted within the peripheral brim 8 and having a height greater than that of the brim 8 so that a gap constituting the aforesaid groove 4 is formed.

On its outer surface, the skirt 11 is provided with vertical projections or ribs 12 in the form of enmeshed small columns extending over its whole height and defining, between them and conjointly with the inner surface of the brim 8, vertical channels 13 independent of one another for the introduction of gas at the level of the gap 4 subsisting between the upper edge 8 and the plate 10. The upper contours of these channels 13 constitute the aforesaid secondary orifices.

At its base, the skirt is provided with traversing notches 15 which, conjointly with the opposite surface of the burner body, define conduit passages for the gas.

Under these conditions, the gas is introduced through the notches 15 into each channel 13. In the gap or annular groove 4 into which all the channels 13 open, a continuous annular collar of secondary flame or pilot flame 5 is established which has, below the main flames 3, more active zones 5*a* heating the feet of the respective main flames.

As is self-evident and as results besides already from the foregoing, the invention is in no way limited to those of its types of application and embodiments which have been more especially envisaged; it encompasses thereof, on the contrary, all modifications.

What is claimed:

1. A pilot flame gas burner, particularly for a domestic appliance, comprising:

a side wall having main orifices distributed peripherally thereabout for main flames, and a peripheral supply means for supplying gas below said main orifices which generates an annular secondary flame collar below said main orifices, wherein in first zones located below intervals between the main orifices the annular secondary flame projects only a minimal distance from the said side wall, and in second zones located below each main orifice the annular secondary flame is more active and projects farther from the side wall than the flames in said first zones, such that the flames of the second zones heat the feet of the corresponding main flames located thereabove.

2. A pilot flame gas burner according to claim 1, comprising a burner body having an upper portion bounded peripherally by a brim projecting upwards from a table and a burner cap having a peripheral skirt projecting downwards and dimensioned to fit within the said brim and resting on the table of the burner body, the side wall and main orifices being situated in the cap, wherein the skirt of the cap has a height substantially greater than the height of the peripheral brim of the body of the burner so that an annular gap exists between the cap and the upper edge of the brim, in which gap the annular secondary flame develops, and wherein at least one of the facing surfaces of the skirt and brim has projections in the form of columns situated in line with gaps separating the main orifices and defining with the facing surfaces channels independent of one another whose upper ends constitute secondary orifices which constitute said second zones, the skirt of the cap having passages situated in line with the main orifices for the introduction of gas into said independent channels.

3. A pilot flame gas burner according to claim 2, wherein the projections are in the form of enmeshed small columns which are provided on the outer surface of the skirt.

4. A pilot flame gas burner according to claim 2, wherein the passages are bounded by notches formed through the base of the skirt and by the surface of the table of the burner body on which the base of the skirt rests.

5. A pilot flame gas burner according to claim 1, said burner comprising a burner body and a burner cap, the cap having a skirt which fits inside of a raised brim on the burner body and said peripheral supply means including an annular space formed between the raised brim and the cap for the passage of gas therethrough.

6. A pilot flame gas burner according to claim 5, said peripheral supply means including means defining channels between the skirt and the brim to direct the supply gas essentially to the second zones.

7. A pilot flame gas burner according to claim 6, said means defining channels comprising projections extending from one of the brim or skirt to the other and located beneath intervals between adjacent main orifices.

8. A pilot flame gas burner according to claim 7, including passageways through the base of the skirt for supplying gas to said channels.

* * * * *